US005426440A

United States Patent [19]

Shimada et al.

[11] Patent Number: 5,426,440

[45] Date of Patent: Jun. 20, 1995

[54] RETRACTABLE ANTENNA DEVICE HAVING A RODLIKE ANTENNA AND A HELIX ANTENNA WHICH IS ELECTRICALLY ISOLATED FROM THE RODLIKE ANTENNA IN THE RETRACTED CONDITION OF THE ANTENNA DEVICE

[75] Inventors: Makoto Shimada, Sendai; Kazunori Satoh, Yokohama; Teruo Nanmoku, Zama; Susumu Otsuki, Yamato, all of Japan

[73] Assignee: Matsushita Electric Industrial Co., Ltd., Osaka, Japan

[21] Appl. No.: 143,047

[22] Filed: Oct. 29, 1993

[30] Foreign Application Priority Data

Feb. 19, 1993 [JP] Japan ..... 5-005455 U

[51] Int. Cl.[6] ..... H01Q 1/24; H01Q 1/36

[52] U.S. Cl. ..... 343/729; 343/702; 343/749

[58] Field of Search ..... 343/749, 729, 725, 901, 343/702, 826, 827, 880, 895, 868, 750, 723, 903, 823, 724, 714; H01Q 1/24, 1/36

[56] References Cited

U.S. PATENT DOCUMENTS

| | | | |
|---|---|---|---|
| 3,254,344 | 5/1966 | Rohrs | 343/901 |
| 4,725,845 | 2/1988 | Phillips | 343/895 X |
| 4,868,576 | 9/1989 | Johnson, Jr. | 343/895 X |
| 5,168,278 | 12/1992 | Morita | 343/702 |

FOREIGN PATENT DOCUMENTS 2257835 1/1993 United Kingdom .

2257836 1/1993 United Kingdom .

*Primary Examiner*—Donald Hajec
*Assistant Examiner*—Tho G. Phan
*Attorney, Agent, or Firm*—Stevens, Davis, Miller & Mosher

[57] ABSTRACT

An antenna device is withdrawable from and receivable in a body of a portable radio device. A rodlike antenna is covered with a rodlike antenna cover, and a helix antenna to which an initial elastic strain is imparted is covered with a cap. A control portion of an electrically-conductive member is movably received in a groove formed in a portion of connection between the rodlike antenna cover and the cap. The rodlike antenna cover is supported on the body of the radio device. In an extended condition of the rodlike antenna, a connection portion of the electrically-conductive member is urged against the rodlike antenna by a restoring load of the helix antenna to electrically connect the spiral antenna to the rodlike antenna. In a retracted condition of the rodlike antenna, the electrically-conductive member is caused to abut against an antenna holder to be spaced apart from the rodlike antenna, thereby interrupting an electrical connection between the helix antenna and the rodlike antenna. In the retracted position of the rodlike antenna, an engagement projection of the cap is releasably engaged with a retaining pawl on the body to hold the rodlike antenna in its retracted position. With this arrangement, antenna characteristics are restrained from being degraded in the retracted condition of the rodlike antenna.

2 Claims, 2 Drawing Sheets

RETRACTABLE ANTENNA DEVICE HAVING A RODLIKE ANTENNA AND A HELIX ANTENNA WHICH IS ELECTRICALLY ISOLATED FROM THE RODLIKE ANTENNA IN THE RETRACTED CONDITION OF THE ANTENNA DEVICE

BACKGROUND OF THE INVENTION

This invention relates to a rodlike antenna device used in a portable radio device (e.g. radio transceiver) or the like, which antenna device is withdrawable from and receivable in a body of the radio device.

One conventional antenna device of the type described is shown in FIG. 3 which is a cross-sectional view of a portion of this antenna device. This antenna device comprises a rodlike antenna 51 covered with a rodlike antenna cover 52, and a helix antenna 53 covered with a resin cap 54. The rodlike antenna 51 is electrically conductively connected at its distal end to the helix antenna 53, and the rodlike antenna cover 52 is integral with the cap 54.

The rodlike antenna cover 52 is mounted on a body (not shown) of a portable radio device in such a manner that the cover 52 is withdrawable from and receivable in the body. When the rodlike cover 52 is withdrawn into an extended position, radio waves are transmitted and received through the helix antenna 53 and the rodlike antenna 51. When the rodlike cover 52 is received in the body, that is, disposed in a retracted position, the rodlike antenna 51 is disposed in the body while the cap 54 is exposed, and therefore in this condition radio waves are transmitted and received mainly through the helix antenna 53 projected from the body.

In the above conventional antenna device, however, when the antenna is in the retracted or received condition, the rodlike antenna 51 received in the body is electrically communicated to the helix antenna 53 projected from the body, which results in a problem that antenna characteristics of the helix antenna are degraded.

SUMMARY OF THE INVENTION

With the above problem of the prior art in view, it is an object of this invention to provide an antenna device in which in a retracted condition of the antenna device, a helix antenna projected from a body is electrically isolated from a rodlike antenna received in the body, thereby restraining antenna characteristics from being degraded.

According to the present invention, there is provided an antenna device comprising:

a rodlike antenna;

an antenna cover covering said rodlike antenna;

an elastically deformable helix antenna disposed near a distal end of said rodlike antenna;

a cap covering said helix antenna and formed integral with the antenna cover; and electrical conduction control means for electrically connecting said helix antenna to said rodlike antenna in said extended position of said rodlike antenna relative to a body by means of a restoring resilient force of said helix antenna and for imparting an elastic strain to said helix antenna in said retracted position of said rodlike antenna relative to the body to interrupt an electrical connection between said helix antenna and said rodlike antenna.

The electrical conduction control means can comprise an electrically-conductive member supported for movement along the axes of the cap and the rodlike antenna cover, and in the extended position of the rodlike antenna relative to the body, the electrically-conductive member being adapted to be urged toward the rodlike-antenna by the restoring resilient force of the helix antenna to be held in contact with the helix antenna and the rodlike antenna, and in the retracted position of the rodlike antenna relative to the body, the electrically-conductive member being adapted to be engaged with the body to impart an elastic strain to the helix antenna and also to be spaced apart from the rodlike antenna; and an engagement portion for releasably retaining the cap relative to the body to keep the electrically-conductive member spaced apart from the rodlike antenna in the retracted position of the rodlike antenna.

In the above construction of the present invention, in the extended position of the rodlike antenna, the helix antenna is electrically connected to the rodlike antenna through the electrical conduction control means, utilizing the restoring resilient force of the helix antenna, and radio waves are transmitted and received through the helix antenna and the rodlike antenna. In the retracted position of the rodlike antenna, the helix antenna receives an elastic strain to be compressed, and the electrical conduction control means is spaced apart from the rodlike antenna to interrupt the electrical connection between the helix antenna and the rodlike antenna, and radio waves are transmitted and received by the helix antenna.

DESCRIPTION OF PREFERRED EMBODIMENT

Figure 1:
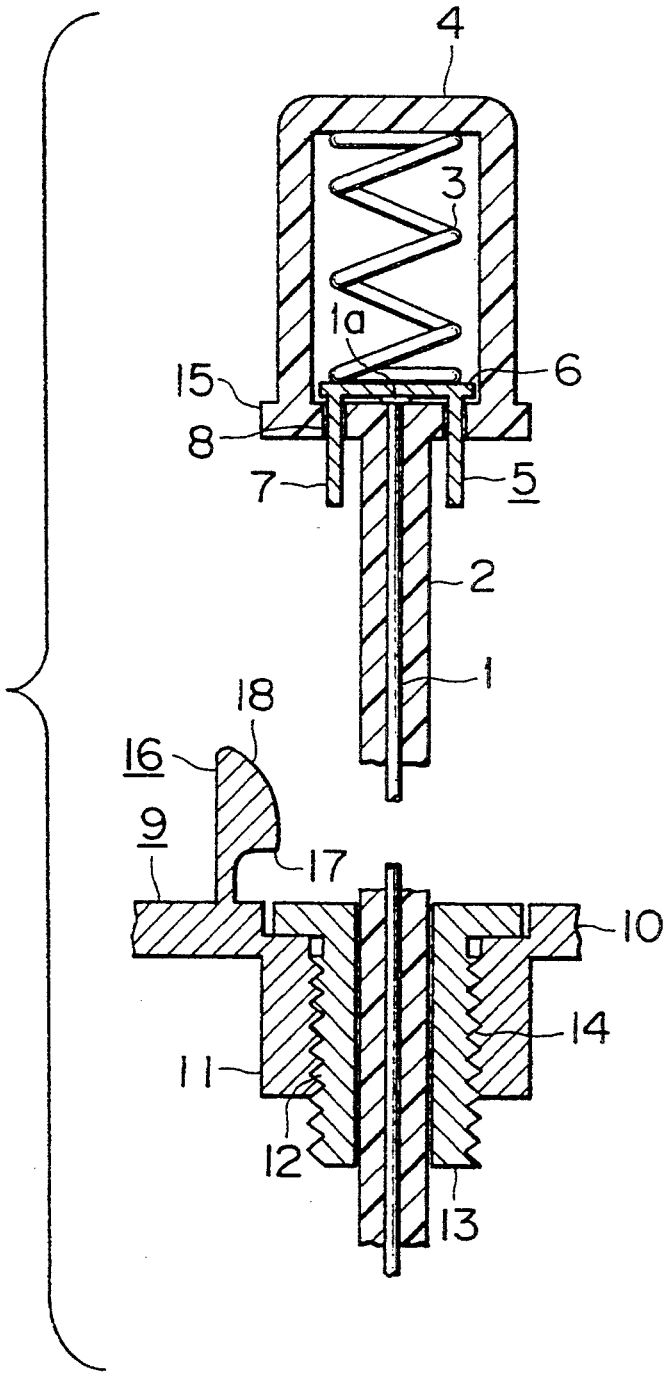
FIG. 1 is a cross-sectional view of an essential portion of an antenna device of the present invention in its extended condition.
Figure 2:
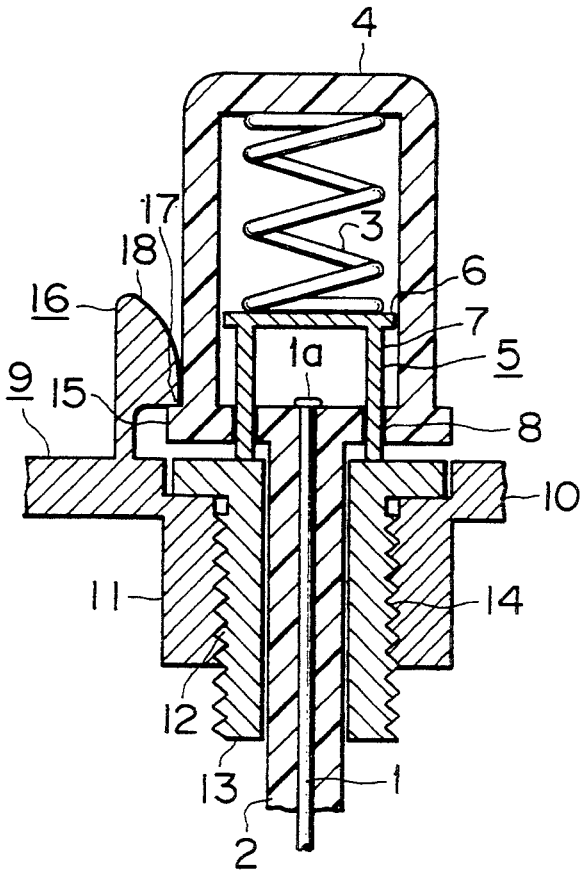
FIG. 2 is view similar to FIG. 1, but in a retracted or received condition of the antenna device.
Figure 3:
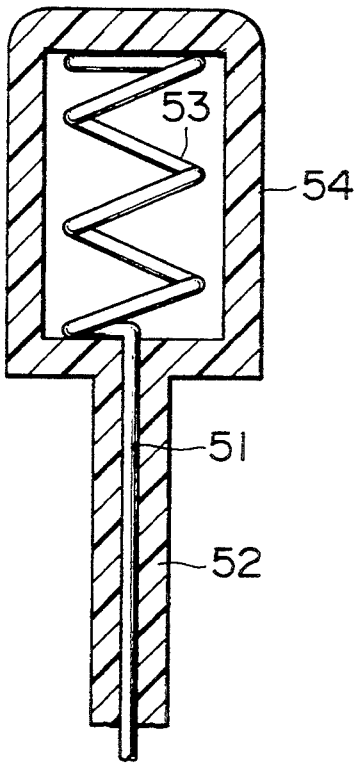
FIG. 3 PRIOR ART
FIG. 3 is a cross-sectional view of a portion of a conventional antenna device.

FIGS. 1 and 2 shows one preferred embodiment of an antenna device of the present invention. FIG. 1 shows an extended condition of the antenna device and the FIG. 2 shows a retracted or received condition of the antenna device.

As shown in FIGS. 1 and 2, a rodlike antenna 1 is covered with a rodlike antenna cover 2, and an elastically deformable, helix antenna 3 is disposed adjacent to a distal end of the rodlike antenna 1 and is covered with a cap 4 of a resin. The rodlike antenna 1, the rodlike antenna cover 2 and the cap 4 are integrally connected together. An electrically-conductive member 5 includes a connection portion 6, and a control portion 7 extending downwardly from a lower surface of the connection portion 6 at an outer peripheral portion thereof. The control portion 7 is received in a groove 8, formed in a portion of connection between the upper end of the rodlike antenna cover 2 and the cap 4, for movement along the axes of the rodlike antenna cover 2 and the cap 4. The electrically-conductive member 5 is urged toward the rodlike antenna 1 by a restoring resilient force (restoring load) of the helix antenna 3, with one side or face of the connection portion 6 held in contact with the helix antenna 3 and the other side of the connection portion 6 held in contact with a projected upper end 1*a* of the rodlike antenna 1. Therefore, the two antennas 1 and 3 are electrically connected to each other by the electrically-conductive member 5 (see FIG. 1). When the electrically-conductive member 5 is urged away from the rodlike antenna 1 to compress the helix antenna 3 between the inner surface of the upper end (closed end) of the cap 4 and the connection portion 6 to thereby impart an elastic strain to the helix antenna 3, the connection portion 6 is brought out of contact with the projected end 1*a* of the rodlike antenna 1, thereby interrupting the electrical connection between the two antennas 1 and 3 (see FIG. 2).

As shown in FIG. 2, a tubular holder portion 11 is formed integrally on an upper wall of a body 10 of a portable radio device 9, and internal threads 12 are formed on an inner peripheral surface of the holder portion 11. The rodlike antenna cover 2 is slidably supported by a tubular antenna holder 13, and external threads 14 are formed on an outer peripheral surface of the antenna holder 13. The antenna holder 13 is mounted on the holder portion 11 of the body 10, with the internal threads 12 on the holder portion 11 engaged with the external threaded 14 on the antenna holder 13. By slidingly moving the rodlike antenna cover 2 relative to the antenna holder 13, the rodlike antenna 1 is moved between an extended position (FIG. 1) where the rodlike antenna 1 is extended relative to the body 10 and a retracted or received position (FIG. 2) where the rodlike antenna 1 is generally fully received in the body 10. In the retracted condition, the control portion 7 of the electrically-conductive member 5 abuts against the upper surface of the antenna holder 13, and therefore the cap 4, containing the helix antenna 3, and the electrically-conductive member 5 are projected outwardly of the body 10.

An engagement projection or flange 15 is formed integrally on an outer periphery of an open end of the cap 4. An engagement pawl 16 is formed integrally on that portion of the upper surface of the body 10 which is disposed adjacent to the cap 4. The engagement pawl 16 has an engagement projection 17 formed integrally on its distal end portion and facing the cap 4. An outer surface of the engagement projection 17 facing the cap 4 serves as a guide surface 18, and is curved away from the cap 4 progressively toward the distal end of the engagement pawl 16. When the rodlike antenna 1 is to be moved to the retracted or received position, the cap 4 is moved toward the body 10, so that the lower outer peripheral edge of the cap 4 is pressed against the guide surface 18 of the engagement pawl 16 to elastically deform the engagement pawl 16 outwardly. Subsequently, when the engagement projection 15 of the cap 4 passes past the guide surface 18, the engagement pawl 16 is returned to its original position, so that the engagement projection 17 becomes engaged with the engagement projection 15 of the cap 4, thereby retaining the cap 4 against backward or upward movement. In contrast, when the rodlike antenna 1 is to be moved to the extended position, the engagement pawl 16 is elastically deformed outwardly, so that the engagement projection 15 of the cap 4 is disengaged from the engagement projection 17 of the engagement pawl 16.

The operation of the antenna device of the above construction will now be described.

Here, let's assume that the rodlike antenna 1 is extended relative to the body 10, as shown in FIG. 1. In this, extended condition, the electrically-conductive member 5, which is electrically communicated to the helix antenna 3, is urged toward the rodlike antenna 1 by the restoring load (restoring resilient force) of the helix antenna (resilient member) 3 to which the initial elastic strain is imparted by the compressive load, and the connection portion 6 of the electrically-conductive member 5 is caused to abut against the projected end 1*a* of the rodlike antenna 1, thereby maintaining the electrical connection between the helix antenna 3 and the rodlike antenna 1. In this condition, radio waves are transmitted and received through the helix antenna 3 and the rodlike antenna 1.

For moving the rodlike antenna 1 into the received or retracted position (FIG. 2), the rod-like antenna cover 2 is slidingly moved relative to the antenna holder 13, so that the engagement projection 15 of the cap 4 is brought into engagement with the guide surface 18 of the engagement pawl 16 on the body 10. Subsequently, the cap 4 is urged toward the body 10 to elastically deform the engagement pawl 16, so that the engagement projection 15 of the cap 4 is engaged with the engagement projection 17 of the engagement pawl 16, thereby retaining the cap 4 against backward movement, as described above. As a result, the rodlike antenna 1 is generally fully received in the body 10, and the electrically-conductive member 5 is raised by the antenna holder 13 to impart an elastic strain greater than the initial elastic strain to the helix antenna 3 to compress the helix antenna 3, so that the electrical contact between the connection portion 6 of the electrically-conductive member 5 and the rodlike antenna 1 is interrupted. Therefore, the electrical connection between the rodlike antenna 1 and the helix antenna 3 is interrupted. In this retracted condition of the antenna device, radio waves are transmitted and received through the helix antenna 3.

For extending the antenna device, the engagement pawl 16 is elastically deformed to disengage the engagement projection 17 from the engagement projection 15 of the cap 4, so that the restoring force due to the energy of the elastic strain stored in the helix antenna 3 causes the helix antenna 3 to axially expand, and also acts on the cap 4, the rodlike antenna cover 2 and the rodlike antenna 1 through the electrically-conductive member 5 in a direction to extend the antenna device relative to the body 10. Then, the cap 4 is pulled to extend the antenna device relative to the body 10 as shown in FIG. 1.

As described above, in the present invention, in the extended position of the rodlike antenna, the helix antenna is electrically connected to the rodlike antenna through the electrical conduction control means, utilizing the restoring resilient force of the helix antenna, and radio waves are transmitted and received through the helix antenna and the rodlike antenna. In the retracted position of the rodlike antenna, the helix antenna receives an elastic strain to be compressed, and the electrical conduction control means is spaced apart from the rodlike antenna to interrupt the electrical connection between the helix antenna and the rodlike antenna, and radio waves are transmitted and received by the helix antenna. Thus, in the extended condition of the rodlike antenna, antenna characteristics analogous to those obtained with a conventional antenna device are achieved, and in the retracted condition of the rodlike antenna, the electrical connection between the helix antenna and the rodlike antenna is interrupted to prevent the antenna characteristics from being degraded.

The electrical conduction control means comprises the electrically-conductive member supported by the cap and the antenna cover for movement along axes of the cap and the antenna cover, and in said extended position of the rodlike antenna, the electrically-conductive member is urged toward the rodlike-antenna by the restoring resilient force of the helix antenna to be held in contact with the helix antenna and the rodlike antenna, and in the retracted position of the rodlike antenna, the electrically-conductive member is engaged with the body to impart an elastic strain to the helix antenna and also to be spaced apart from the rodlike antenna, and the electrical conduction control means further comprises the engagement portion for releasably retaining the cap relative to the body to keep the electrically-conductive member spaced apart from the rodlike antenna in the retracted position of the rodlike antenna. By virtue of the provision of this electrical conduction control means, when the antenna is to be automatically extended from the retracted condition by the energy of the elastic force stored in the helix antenna, the retaining of the cap by the engagement portion is released by one touch action to cause the cap and other associated parts to move upward away from the body. This enhances the operability of the antenna device.

What is claimed is:

1. An antenna device comprising:

a rodlike antenna;

an antenna cover covering said rodlike antenna, an elastically deformable helix antenna disposed near a distal end of said rodlike antenna;

a cap covering said helix antenna and connected With said antenna cover;

electrical conduction control means for electrically connecting said helix antenna to said rodlike antenna in an extended position of said rodlike antenna relative to a body by means of a restoring resilient force of said helix antenna and for imparting an elastic strain to said helix antenna in a retracted position of said rodlike antenna relative to the body to interrupt an electrical connection between said helix antenna and said rodlike antenna, said electrical conduction control means comprising an electrically-conductive member supported for movement along the axes of said cap and said rodlike antenna cover, and in said extended position of said rodlike antenna relative to said body, said electrically-conductive member being adapted to be urged toward said rodlike-antenna by the restoring resilient force of said helix antenna to be held in contact with said helix antenna and said rodlike antenna, and in said retracted position of said rodlike antenna relative to said body, said electrically-conductive member being adapted to be engaged with said body to impart an elastic strain to said helix antenna and also to be spaced apart from said rodlike antenna; and an engagement portion for releasably retaining said cap relative to said body to keep said electrically-conductive member spaced apart from said rodlike antenna in said retracted position of said rodlike antenna.

2. An antenna device as in claim 1, wherein said cap and said antenna cover are formed integrally together.

* * * * *